US007984817B1

(12) United States Patent
Everett

(10) Patent No.: US 7,984,817 B1
(45) Date of Patent: Jul. 26, 2011

(54) COMBINED PACIFIER AND BEVERAGE CONTAINER

(76) Inventor: Shanina T. Everett, Hot Springs, AR (US)

( * ) Notice: Subject to any disclaimer, the term of this patent is extended or adjusted under 35 U.S.C. 154(b) by 637 days.

(21) Appl. No.: 12/011,041

(22) Filed: Jan. 24, 2008

(51) Int. Cl.
*A61J 9/04* (2006.01)
*B65D 55/16* (2006.01)
*B65D 51/18* (2006.01)

(52) U.S. Cl. ..... 215/11.5; 215/306; 220/212; 220/375

(58) Field of Classification Search ..... 215/11.5, 215/11.4, 11.1, 229, 228, 389, 388, 387; 220/709, 707, 705, 254.9, 254.3, 254.2, 254.1, 220/345.1, 212; 222/559, 544, 523, 522, 222/545; 206/217, 216; D7/300.2; D9/449, D9/447, 435; D24/194, 193, 197, 199, 196; 606/236, 235, 234; *B65D 55/16*
See application file for complete search history.

(56) References Cited

U.S. PATENT DOCUMENTS 102,417 A * 4/1870 Mason ..... 215/228
224,557 A * 2/1880 Potter ..... 215/11.1
2,824,561 A * 2/1958 Mueller ..... 215/11.1
2,954,030 A * 9/1960 Jozwiak ..... 215/11.1
3,426,755 A * 2/1969 Clegg ..... 604/77
4,475,559 A * 10/1984 Horn ..... 600/529
4,898,290 A * 2/1990 Cueto ..... 215/11.1
4,898,291 A * 2/1990 Sailors ..... 215/11.4
4,994,076 A * 2/1991 Guss ..... 606/236
5,512,047 A * 4/1996 Dvorak ..... 604/77
6,250,487 B1 * 6/2001 Tebeau ..... 215/11.1
6,454,788 B1 * 9/2002 Ashton ..... 606/234
6,923,332 B1 * 8/2005 Thomas ..... 215/11.1

* cited by examiner

*Primary Examiner* — Anthony Stashick
*Assistant Examiner* — Robert J Hicks

(57) ABSTRACT

A combined pacifier and beverage container assembly includes a beverage container that has a hollow chamber and a top opening in fluid communication with the hollow chamber. A cap is coupled to the top opening and has a first tubular conduit that has a bottom end seated within the chamber and a top end protruding upwardly away from the cap. A second tubular conduit is attached to the first conduit. A pacifier section is coupled to the second conduit. The pacifier section includes a protective cover tethered to a rear end that has a body spaced from the pacifier section and is provided with a cavity coextensively shaped with the rear end of the pacifier section. The pacifier section is provided with an axial bore that travels along its entire length. The bore is in fluid communication with the second conduit.

12 Claims, 6 Drawing Sheets

COMBINED PACIFIER AND BEVERAGE CONTAINER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to beverage containers and, more particularly, to a combined pacifier and beverage container for allowing an infant to access bottled liquids without assistance from a caregiver.

2. Prior Art

Baby feeding bottles generally consist of a bottle having an open end with a suitable nipple mounted on the open end of the bottle via a retainer ring or the like. One problem with this arrangement is that when babies are unable to hold the bottle themselves, and parents or other care givers are unable to do so, for example while traveling, there is no effective way to feed the baby. Also, even babies capable of holding bottles are liable to drop them or turn them upside down, potentially spilling the contents.

On such occasions, the nursing bottle is attempted to be propped up, by blankets or by some crib accessory such as a stuffed animal or toy, and/or the baby is left to maintain a proper orientation of the bottle. In any of these methods of nursing bottle support, often the proper inverted position of the nursing bottle is not maintained, due to the weight or awkwardness of the nursing bottle to the baby, or to the unsteady nature of the propping means or to whatever other reason; and untold millions have then experienced the annoyance and inconvenience of the infant crying aloud until the proper bottle-position is again re-established. Nursing bottles have been proposed in the past in which a flexible suction tube extends from the bottle and has a nipple assembly secured at its free end. This allows the bottle to be secured at a remote location while the baby is feeding.

One prior art example discloses a bottle device that allows a nipple to be disposed within an infant's mouth where the infant or its caregiver does not have to hold the bottle in an inverted position for liquid to flow. Rather, the bottle can be placed adjacent to the infant and the tube permits the flow of liquid from the bottle to the nipple disposed in the infant's mouth. A drawback of this type of bottle device is that fluid in the extended feeding tube will drain away from the nipple and back into the bottle when the nipple is sufficiently elevated above the bottle. This condition can lead to the infant sucking and ingesting air in a vain attempt to obtain liquid through the nipple. Conversely, fluid will leak from the nipple continuously where the nipple is sufficiently lowered below the elevation of the bottle. This condition can lead to the draining of the bottle contents into the bedding of the infant. Thus, either condition creates a less than optimum performance of the device.

Accordingly, a need remains for a combined pacifier and beverage container in order to overcome the above-noted shortcomings. The present invention satisfies such a need by providing an assembly that is convenient and easy to use, durable yet lightweight in design, versatile in its applications, and allows parents or caregivers to simultaneously perform other tasks while a child is feeding. Harried parents of multiple children can give their baby a bottle while they feed, bathe, or otherwise care for the infant's siblings. While keeping an eye on the infant's feeding, parents or caregivers can also straighten a room, do the dishes, or perform other tasks as the infants is feeding from the assembly. Feeding an infant can take from 30-40 minutes, which is a long stretch of time to devote undivided attention to one task. The combined pacifier and beverage container advantageously allows a parent or caregiver to multi-task while the baby is feeding. Such an assembly also conveniently allows a toddler or infant to safely feed while being seated in a car seat.

BRIEF SUMMARY OF THE INVENTION

In view of the foregoing background, it is therefore an object of the present invention to provide a combined pacifier and beverage container. These and other objects, features, and advantages of the invention are provided by a combined pacifier and beverage container assembly for allowing an infant to access bottled liquids without assistance from a caregiver.

The combined pacifier and beverage container assembly includes a beverage container that has a hollow chamber formed therein and is provided with a top opening in fluid communication with the chamber. A cap is removably coupled directly to the top opening. Such a cap has a first tubular conduit monolithically formed therewith. The first tube has a bottom end seated within the chamber and further has a top end protruding upwardly away from the cap. The cap may be provided with an air inlet passing therethrough. Such an air inlet travels parallel to the first tubular conduit. A second tubular conduit is removably attached to the first tubular conduit.

A pacifier section is removably and directly coupled to the second tubular conduit in such a manner that the second tubular conduit and the pacifier section extend outwardly and away from the cap while the infant is receiving the fluids housed within the beverage container. Such a pacifier section includes a protective cover tethered to a rear end thereof. The protective cover has a body spaced from the pacifier section and is provided with a cavity coextensively shaped with the rear end of the pacifier section so that the body removably snaps onto the rear end during non-operating conditions. Such a pacifier section is provided with an axial bore formed therein that travels along an entire longitudinal length of the pacifier section. The bore is in fluid communication with the second conduit.

The pacifier section preferably includes a mouth guard that has a rear end removably coupled directly to the second tubular conduit. A nipple section is removably connected directly to the mouth guard. Such a nipple is provided with a plurality of openings and a cavity spaced between the openings. The cavity is in fluid communication with the axial bore and the openings respectively.

The assembly may further include a gasket positioned directly over the top opening. Such a gasket has a centrally registered aperture formed therein. The cap is preferably positioned on top of the gasket such that the cap directly abuts and rests on the gasket. Such a cap has a threaded inner perimeter threadably secured to the open top end. The threaded inner perimeter is spaced from the gasket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
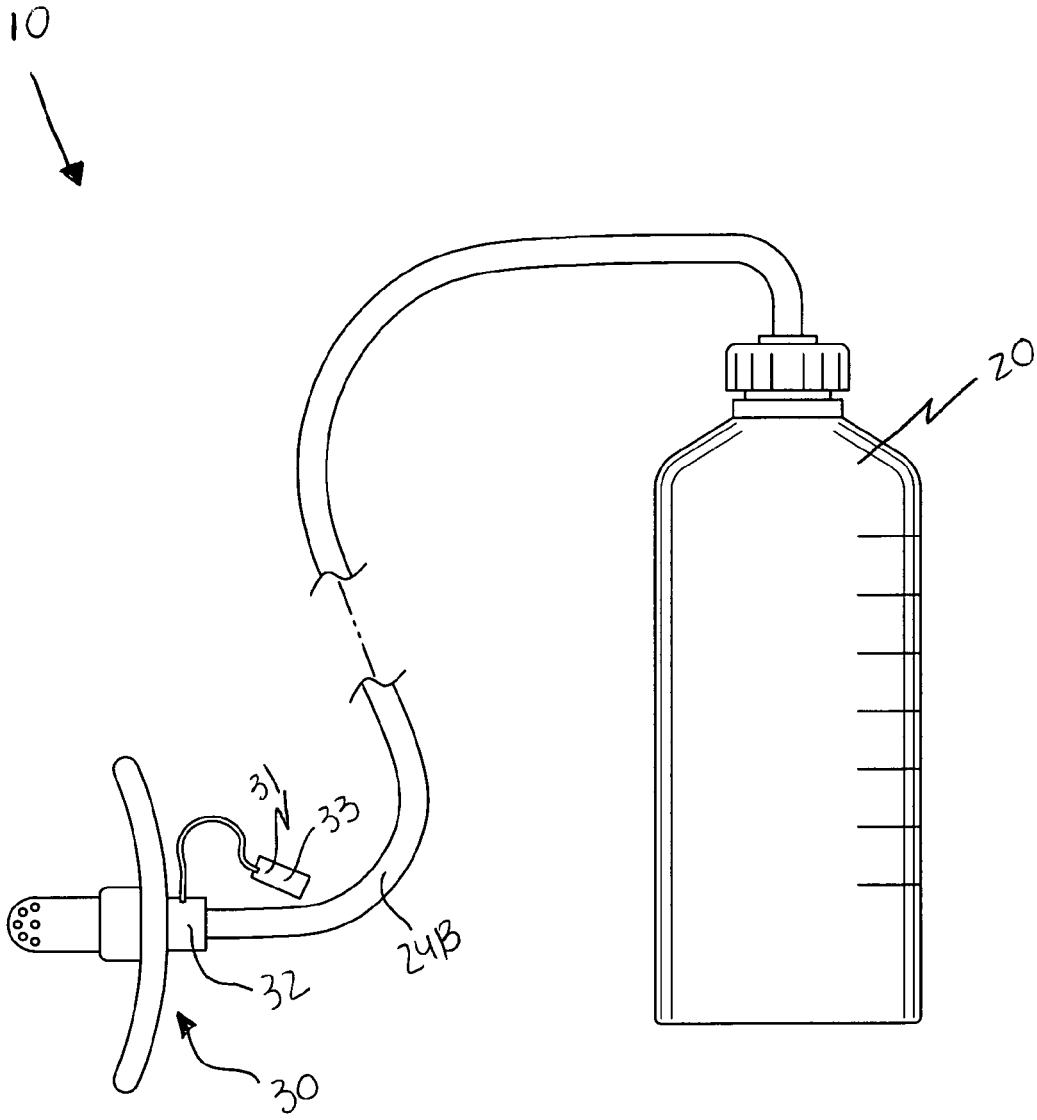
FIG. 1 is a front-elevational view showing a combined pacifier and beverage container, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refer to an alternate embodiment of such elements.

The assembly of this invention is referred to generally in FIGS. 1-6 by the reference numeral 10 and is intended to provide a combined pacifier and beverage container. It should be understood that the assembly 10 may be used by many different types of persons, and should not be limited in use to only infants and toddlers.

Figure 2:
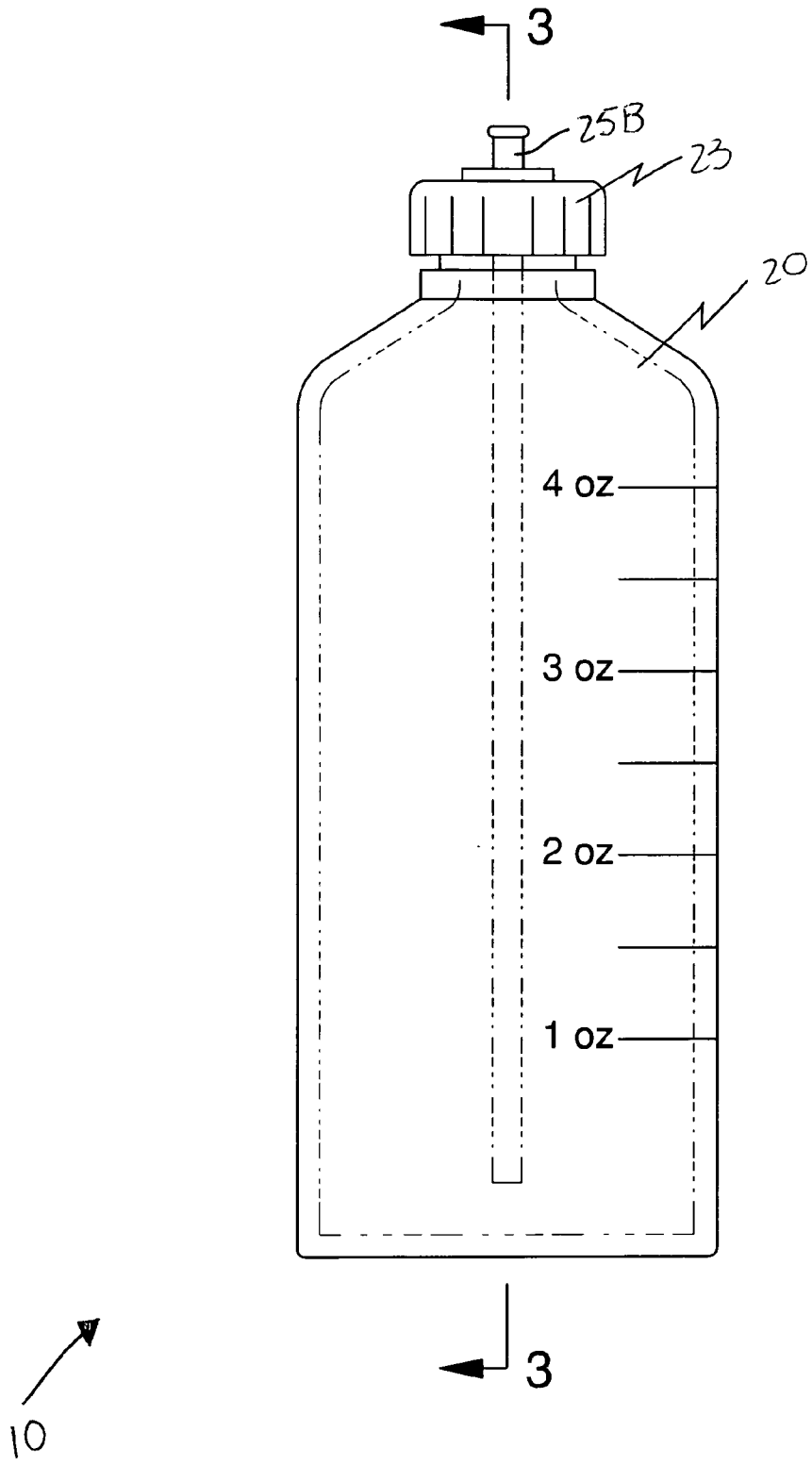
FIG. 2 is an enlarged front-elevational view of the beverage container shown in FIG. 1.
Figure 3:
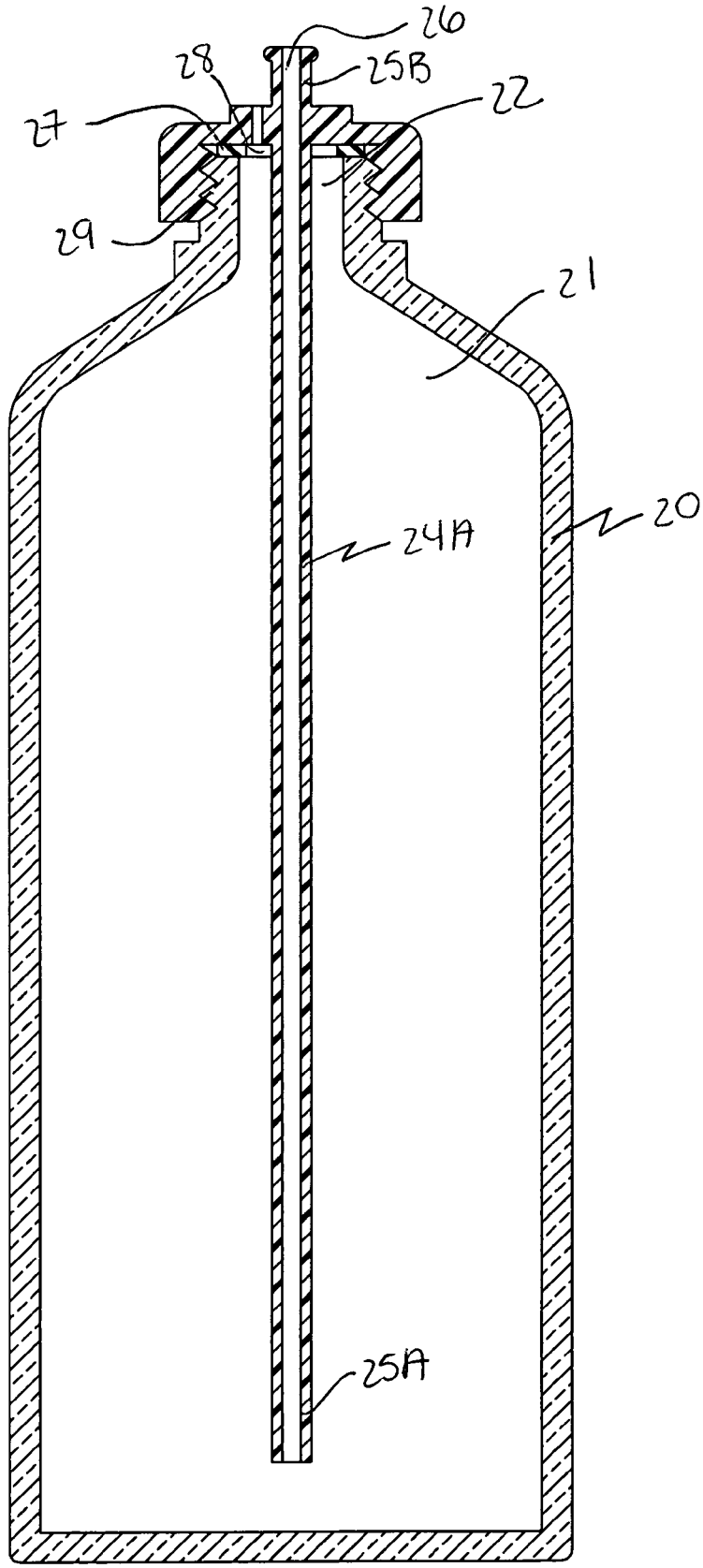
FIG. 3 is a cross-sectional view of the beverage container shown in FIG. 2, taken along line 3-3.

Referring initially to FIGS. 1, 2 and 3, the assembly 10 includes a beverage container 20 that has a hollow chamber 21 formed therein and is provided with a top opening 22 in fluid communication with the chamber 21, which is essential such that fluids housed within the chamber 21 can effectively exit therefrom through the top opening 22. Of course, the beverage container 20 may be produced in a variety of alternate shapes, sizes and colors, as is obvious to a person of ordinary skill in the art. A cap 23 is removably coupled directly, without the use of intervening elements, to the top opening 22. Such a cap 23 has a first tubular conduit 24A monolithically formed therewith.

The first conduit 24A has a bottom end 25A seated within the chamber 21 and further has a top end 25B protruding upwardly away from the cap 23. The cap 23 is provided with an air inlet 26 passing therethrough, which is crucial for effectively allowing fluids to freely flow from the beverage container 20. Such an air inlet 26 travels parallel to the first tubular conduit 24A. A second tubular conduit 24B is removably attached to the first tubular conduit 24A. Such tubular conduits 24 are critical for allowing an infant or toddler to conveniently and effectively extract fluid from the beverage container 20 without having to be in a supine position or with the assistance of a parent/caregiver, as is the case with other beverage containers disclosed in the prior art. Of course, the beverage container 20 may have graduated markings formed on an outer surface thereof for conveniently allowing a user to measure the amount of fluid housed therein, as is obvious to a person of ordinary skill in the art.

Referring to FIG. 3, the assembly 10 further includes a gasket 27 positioned directly, without the use of intervening elements, over the top opening 22. Such a gasket 27 has a centrally registered aperture 28 formed therein. The cap 23 is positioned on top of the gasket 27 such that the cap 23 directly abuts, without the use of intervening elements, and rests on the gasket 27, which is important and advantageous for preventing fluid from leaking out of the beverage container 20 during operating conditions. Such a cap 23 has a threaded inner perimeter 29 threadably secured to the open top end 22. The threaded inner perimeter 29 is spaced from the gasket 27.

Figure 4:
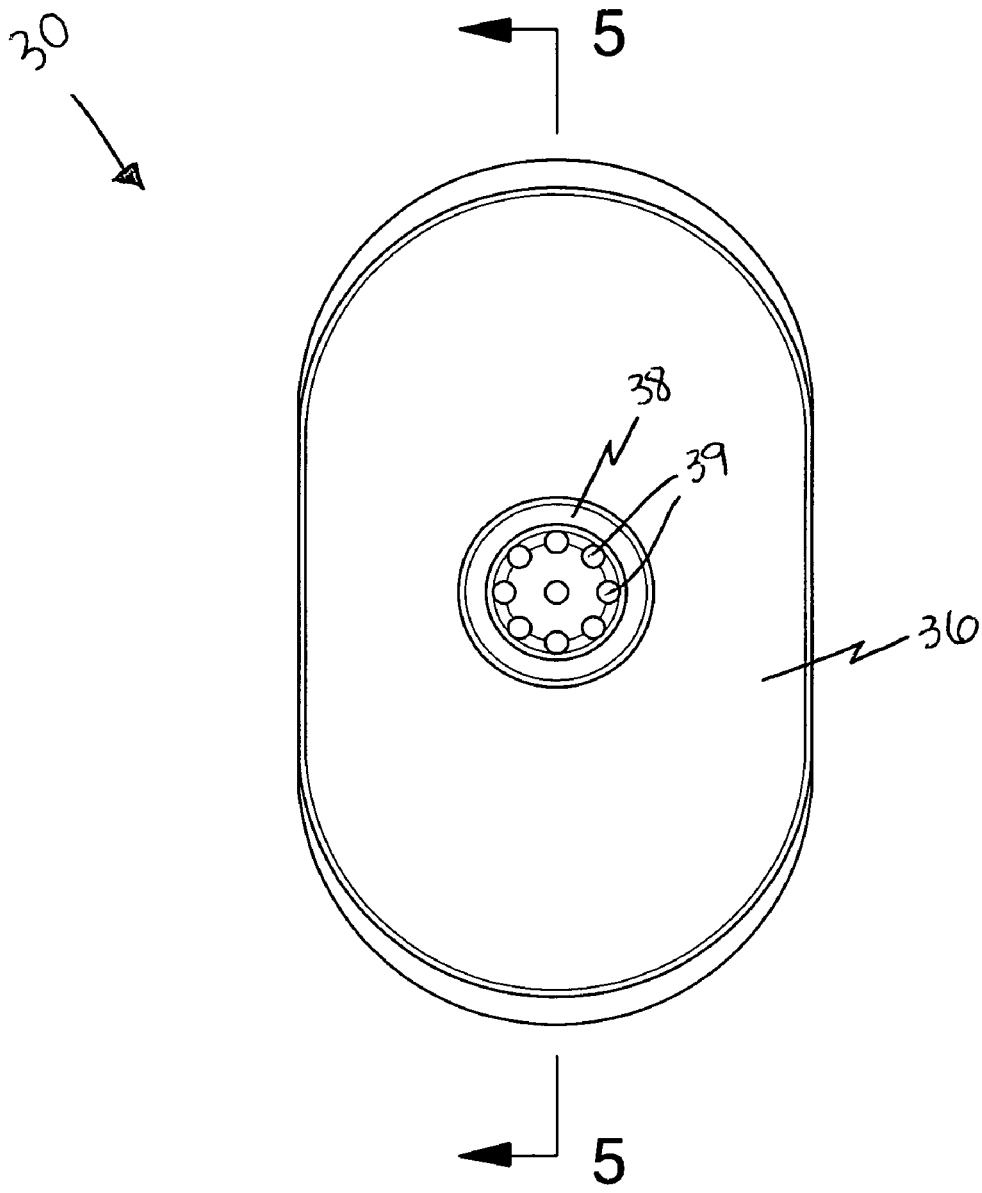
FIG. 4 is a front-elevational view of the pacifier section shown in FIG. 1, showing the plurality of openings provided with the nipple.
Figure 5:
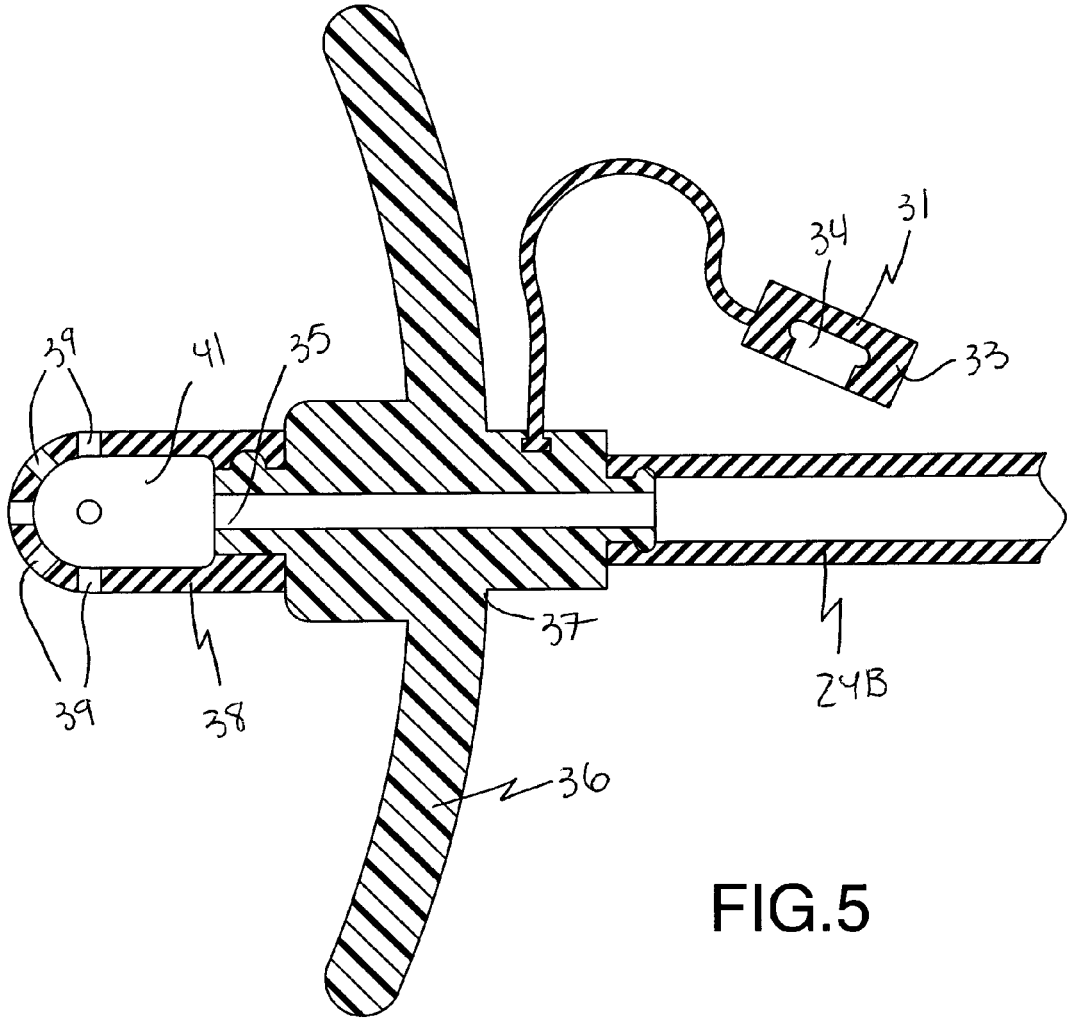
FIG. 5 is a cross-sectional view of the pacifier section shown in FIG. 4, taken along line 5-5.

Referring to FIGS. 1, 4 and 5, a pacifier section 30 is removably and directly coupled, without the use of intervening elements, to the second tubular conduit 24B in such a manner that the second tubular conduit 24B and the pacifier section 30 extend outwardly and away from the cap 23 while the infant is receiving the fluids housed within the beverage container 20. Such a pacifier section 30 includes a protective cover 31 tethered to a rear end 32 thereof. The protective cover 31 has a body 33 spaced from the pacifier section 30 and is provided with a cavity 34 coextensively shaped with the rear end 32 of the pacifier section 30 so that the body 33 removably snaps onto the rear end 32 during non-operating conditions. Such a pacifier section 30 is provided with an axial bore 35 formed therein that travels along an entire longitudinal length of the pacifier section 30, as is best shown in FIG. 5. The bore 35 is in fluid communication with the second conduit 24B, which is an important and advantageous feature for forming a continuous and un-obstructed passage from the beverage container 20 to the pacifier section 30.

Again referring to FIGS. 1, 4 and 5, the pacifier section 30 includes a mouth guard 36 that has a rear end 37 removably coupled directly, without the use of intervening elements, to the second tubular conduit 24B. A nipple section 38 is removably connected directly, without the use of intervening elements, to the mouth guard 36. Such a nipple 38 is provided with a plurality of openings 39 and a cavity 41 spaced between the openings 39. The cavity 41 is in fluid communication with the axial bore 35 and the openings 39 respectively, which is a vital feature for effectively allowing fluids to pass through the pacifier section 30 to an infant or toddler sucking on the nipple section 38.

Figure 6:
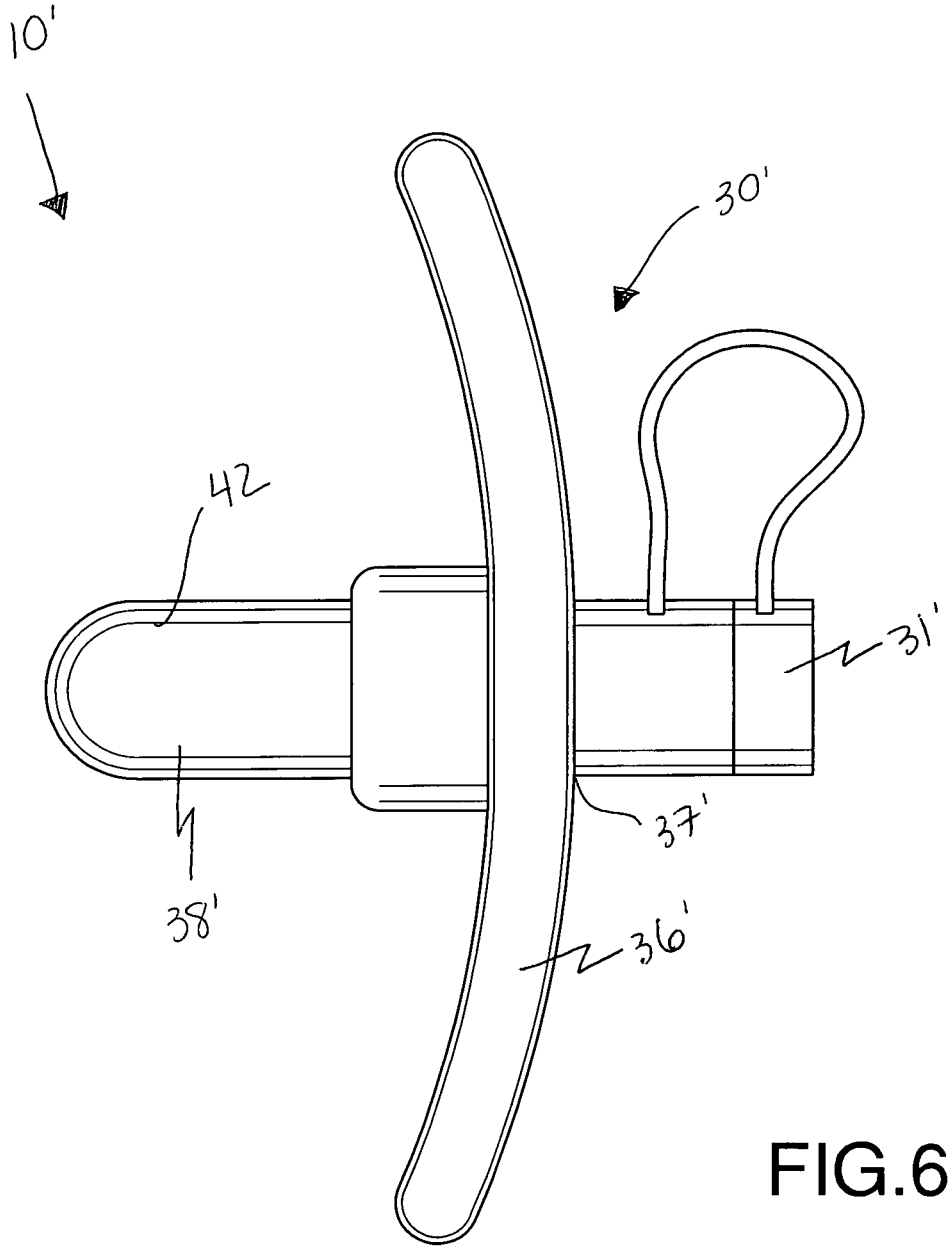
FIG. 6 is a side-elevational view showing an alternate embodiment of the pacifier section shown in FIG. 1, in accordance with the present invention.

Referring to FIG. 6, in an alternate embodiment 10', the pacifier section 30' includes a nipple section 38' that has a continuous outer surface 42. Such a continuous outer surface 42 conveniently allows an infant or toddler to use the pacifier section 38' as they would any other conventional pacifier (not shown).

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined pacifier and beverage container assembly for allowing an infant to access bottled liquids without assistance from a caregiver, said combined pacifier and beverage container assembly comprising:

a beverage container having a hollow chamber formed therein and being provided with a top opening in fluid communication with said chamber;

a cap removably coupled directly to said top opening, said cap having a first tubular conduit monolithically formed therewith, said first tube having a bottom end seated within said chamber and further having a top end protruding upwardly away from said cap;

a second tubular conduit removably attached to said first tubular conduit; and a pacifier section removably and directly coupled to said second tubular conduit in such a manner that said second tubular conduit and said pacifier section extend outwardly and away from said cap while the infant is receiving the fluids housed within said beverage container, wherein said pacifier section comprises: a protective cover tethered to a rear end thereof, said protective cover having a body spaced from said pacifier section and being provided with a cavity coextensively shaped with said rear end of said pacifier section so that said body removably snaps onto said rear end during non-operating conditions.

2. The assembly of claim 1, wherein said pacifier section comprises:

a mouth guard having a rear end removably coupled directly to said second tubular conduit; and a nipple section removably connected directly to said mouth guard, wherein a nipple is provided with a plurality of openings and a cavity spaced between said openings, said cavity being in fluid communication with an axial bore and said openings respectively.

3. The assembly of claim 1, further comprising:

a gasket positioned directly over said top opening, said gasket having a centrally registered aperture formed therein.

4. The assembly of claim 3, wherein said cap is positioned on top of said gasket such that said cap directly abuts and rests on said gasket.

5. The assembly of claim 4, wherein said cap has a threaded inner perimeter threadably secured to said open top end, said threaded inner perimeter being spaced from said gasket.

6. The assembly of claim 1, wherein said cap is provided with an air inlet passing therethrough, said air inlet traveling parallel to said first tubular conduit.

7. A combined pacifier and beverage container assembly for allowing an infant to access bottled liquids without assistance from a caregiver, said combined pacifier and beverage container assembly comprising:

a beverage container having a hollow chamber formed therein and being provided with a top opening in fluid communication with said chamber;

a cap removably coupled directly to said top opening, said cap having a first tubular conduit monolithically formed therewith, said first tube having a bottom end seated within said chamber and further having a top end protruding upwardly away from said cap;

a second tubular conduit removably attached to said first tubular conduit; and a pacifier section removably and directly coupled to said second tubular conduit in such a manner that said second tubular conduit and said pacifier section extend outwardly and away from said cap while the infant is receiving the fluids housed within said beverage container, wherein said pacifier section comprises: a protective cover tethered to a rear end thereof, said protective cover having a body spaced from said pacifier section and being provided with a cavity coextensively shaped with said rear end of said pacifier section so that said body removably snaps onto said rear end during non-operating conditions, wherein said pacifier section is provided with an axial bore formed therein and traveling along an entire longitudinal length of said pacifier section, said bore being in fluid communication with said second conduit.

8. The assembly of claim 7, wherein said pacifier section comprises:

a mouth guard having a rear end removably coupled directly to said second tubular conduit; and a nipple section removably connected directly to said mouth guard, wherein a nipple is provided with a plurality of openings and a cavity spaced between said openings, said cavity being in fluid communication with said axial bore and said openings respectively.

9. The assembly of claim 7, further comprising:

a gasket positioned directly over said top opening, said gasket having a centrally registered aperture formed therein.

10. The assembly of claim 9, wherein said cap is positioned on top of said gasket such that said cap directly abuts and rests on said gasket.

11. The assembly of claim 10, wherein said cap has a threaded inner perimeter threadably secured to said open top end, said threaded inner perimeter being spaced from said gasket.

12. The assembly of claim 7, wherein said cap is provided with an air inlet passing therethrough, said air inlet traveling parallel to said first tubular conduit.

* * * * *